US006364323B1

(12) United States Patent
Coulter

(10) Patent No.: US 6,364,323 B1
(45) **Date of Patent: *Apr. 2, 2002**

(54) TOOL-FREE ADJUSTMENT SYSTEM FOR A LEG SUPPORT MEMBER OF A BINDING

(75) Inventor: Ryan Coulter, Stowe, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/456,221

(22) Filed: Dec. 7, 1999

(51) Int. Cl.[7] ..... B62B 9/04; A43B 5/04

(52) U.S. Cl. ..... 280/14.22; 36/118.8

(58) Field of Search ..... 280/11.36, 14.21, 280/14.22, 611, 613, 614, 617, 618, 619, 624, 631, 632, 633, 809, 842; 441/70; 36/22.2, 118.7, 118.8; 292/247, 113, DIG. 60; 24/68 SK, 68 CD

(56) References Cited

U.S. PATENT DOCUMENTS

| | | | | |
|---|---|---|---|---|
| 3,854,743 A | * | 12/1974 | Hansen | 36/117.4 |
| 4,133,119 A | | 1/1979 | Kubelka | |
| 4,367,885 A | * | 1/1983 | Ramer | 280/614 |
| 4,379,370 A | * | 4/1983 | Balbinot | 36/121 |
| 4,473,235 A | | 9/1984 | Burt | |
| 4,494,939 A | | 1/1985 | Calapp et al. | |
| 4,739,563 A | * | 4/1988 | Guggenberger et al. | 36/117 |
| 4,922,633 A | * | 5/1990 | Sartor | 36/117 |
| 4,969,655 A | | 11/1990 | Katz | |
| 4,979,760 A | | 12/1990 | Derrah | |
| 5,026,087 A | * | 6/1991 | Wulf | 280/613 |
| 5,277,635 A | | 1/1994 | Gillis | |
| 5,356,170 A | | 10/1994 | Carpenter et al. | |
| 5,417,443 A | | 5/1995 | Blattner et al. | |
| 5,470,085 A | | 11/1995 | Meibock et al. | |
| 5,549,310 A | | 8/1996 | Meibock et al. | |
| 5,556,123 A | | 9/1996 | Fournier | |
| 5,647,146 A | | 7/1997 | Gabrielli et al. | |
| 5,660,410 A | | 8/1997 | Alden | |
| 5,727,797 A | | 3/1998 | Bowles | |
| 5,848,796 A | | 12/1998 | Meibock et al. | |
| 5,906,058 A | | 5/1999 | Rench et al. | |
| 6,027,136 A | | 2/2000 | Phillips | |

FOREIGN PATENT DOCUMENTS

| | | | | |
|---|---|---|---|---|
| DE | 89 02 125 U1 | * | 5/1989 | ..... A63C/9/084 |
| DE | 19800180 A1 | | 7/1998 | |
| EP | 0 307 745 A2 | | 3/1989 | |
| EP | 0855203 A1 | | 7/1998 | |
| FR | 2736842 A1 | | 1/1997 | |
| WO | WO 93/14835 | | 8/1993 | |
| WO | WO97/27773 | | 8/1997 | |

* cited by examiner

*Primary Examiner*—Brian L. Johnson
*Assistant Examiner*—G B Klebe
(74) *Attorney, Agent, or Firm*—Wolf, Greenfield & Sacks

(57) ABSTRACT

A tool-free system includes a tool-free forward-lean adjuster that securely positions a leg support member in a desired forward-lean position and a latch coupled to the forward-lean adjuster that secures the leg support member to the binding to prevent toe-edge travel. Quick and convenient adjustment of the forward-lean of the leg support member may be performed without the use of a separate tool. The latch may be latched and unlatched without disturbing the selected forward-lean adjustment because actuation of the latch occurs independently of actuation of the forward-lean adjuster.

38 Claims, 7 Drawing Sheets

TOOL-FREE ADJUSTMENT SYSTEM FOR A LEG SUPPORT MEMBER OF A BINDING

BACKGROUND OF THE INVENTION

1. Field of the Invention

This invention relates generally to bindings and, more particularly, to bindings with a tool-free forward-lean adjuster for a leg support member.

2. Related Art

Snowboard boot binding systems may include an upright leg support member called a "highback" (also referred to as a "lowback" and as a "SKYBACK"). The leg support member acts as a lever that helps transmit forces directly to and from the board, allowing the rider to efficiently control the board through leg movement. For example, flexing one's legs rearward against the leg support member places the board on its heel edge, with a corresponding shift in weight and balance acting through the leg support member to complete a heelside turn. In one example, the leg support member abuts a heel hoop of a binding baseplate so that forces applied through the boot to the leg support member are transmitted through the heel hoop into the board. The leg support member may be mounted for forward rotation in a heel-to-toe direction to position the leg support member in a desired angular position (referred to in snowboarding as "forward-lean").

To position the highback in a desired forward-lean position, a forward-lean adjuster is typically provided on the highback to allow the rider to select the angular position of the highback for comfort and control. The forward-lean adjuster may include a movable body or other incrementally adjustable member which engages the heel hoop to limit the rearward pivoting of the highback beyond the desired forward-lean setting.

The movable body of the forward-lean adjuster is typically secured to the highback via a screw and nut assembly. Securing the movable body with a screw and nut assembly is often times desirable because it may reduce the risk of inadvertently moving the body relative to the highback, especially during aggressive leaning against the highback. To reposition the body, a separate tool, such as a screwdriver and/or a wrench, is typically required to loosen or remove the screw. Once the body is repositioned, the tool is employed to tighten the screw and resecure the body to the highback.

It may be desirable to change the forward-lean angle of the highback for different types of riding. In this respect, the particular forward-lean angle of the highback relative to the board may be selectively adjusted by the rider for comfort, control and one's particular riding style. However, the required tool may not be readily available to the rider. In addition, manipulation of the tool may be cumbersome, especially when attempting to manipulate the tool with gloved hands. To address these concerns, tool-free forward-lean adjusters have been developed so that quick and convenient adjustment of forward-lean of the highback, without the use of a tool, may be made.

One example of such a tool-free forward-lean adjuster is the tool-free, thumbscrew forward-lean adjuster available on FREESTYLE® bindings available from The Burton Corporation, the assignee of the present invention. In this product, the forward-lean adjuster is secured to the highback by a screw that is coupled to a knob suitably sized and shaped to allow a rider to loosen and tighten the screw using, for example, the rider's gloved hand.

Another example of a tool-free forward-lean adjuster is disclosed in U.S. Pat. No. 5,727,797. The forward-lean adjuster employs a cam-actuated mechanism to quickly adjust the forward-lean of the highback. The forward-lean adjuster includes a slidable block that is positionable in a plurality of positions to adjust the forward-lean of the highback. A quick release locking mechanism is attached to the highback for selectively engaging the slidable block to prevent relative movement between the block and the highback. The releasable locking mechanism has a handle adapted to be gripped by hand and a driver connected to the handle. The handle may be actuated to an unlocked position to disengage the driver from the block so that the block may slide along the highback. Similarly, the handle may be actuated to a locked position to engage the driver with the block to secure the block to the highback.

In some instances, it may be desirable to provide a highback and binding system for preventing toe-edge travel of the highback in order to enhance the interaction of the snowboard, boot and binding, and to facilitate a rider's anticipation, initiation and completion of heel-side and toe-side turns as well as the rider's sense and feel of the snowboard. With the highback maintained in a constant position, the force generated by flexing of the rider's legs is quickly translated to the board, particularly when shifting from a toe-edge to a heel-edge, thereby increasing responsiveness of the snowboard to a rider's movements.

An example of such a binding including a system for preventing such toe-edge travel of the highback is described in co-pending U.S. patent application Ser. No. 08/780,722, assigned to The Burton Corporation. As disclosed therein, the highback may be clamped to the baseplate in a desired forward-lean position using a latch to lock the highback to the heel hoop of the binding. The latch is pivotally secured to the forward-lean adjuster.

It is an object of the present invention to provide an improved tool-free forward-lean adjuster for a leg support member.

SUMMARY OF THE INVENTION

According to one illustrative embodiment of the present invention, a tool-free system for retaining a leg support member of a binding in a selected orientation is provided. The binding has a base and a leg support member constructed and arranged for selective orientation relative to the base. The system includes a tool-free forward-lean adjuster having a body that is selectively mountable to the leg support member in a plurality of positions to set the leg support member at a selected forward-lean angle. A fastener is configured and arranged to secure the body to the leg support member in one of the plurality of positions to prevent movement of the body relative to the leg support member. A tool-free actuator is coupled to the fastener to allow tool-free actuation of the fastener to selectively tighten and loosen the body against the leg support member. A latch is operatively coupled to the tool-free forward-lean adjuster. The latch has a locking portion constructed and arranged for releasably engaging the base to prevent toe-edge pivoting of the leg support member. The latch is configured and arranged to move between a first position in which the locking portion is engageable with the base and a second position in which the locking portion is disengageable from the base. The latch is movable between the first and second positions without simultaneous actuation of the fastener.

Further features and advantages of the present invention, as well as the structure and operation of various embodiments of the present invention, are described in detail below with reference to the accompanying drawings.

BRIEF DESCRIPTION OF THE DRAWINGS

The invention will now be described, by way of example, with reference to the accompanying drawings, in which.

DETAILED DESCRIPTION

The present invention is directed to a tool-free system having a tool-free forward-lean adjuster that securely positions a leg support member in a desired forward-lean position and a latch coupled to the forward-lean adjuster that secures the leg support member to the binding to prevent toe-edge travel. Quick and convenient adjustment of the forward-lean of the leg support member may be performed without the use of a separate tool. The latch may be latched and unlatched without disturbing the selected forward-lean adjustment because actuation of the latch occurs independently of actuation of the forward-lean adjuster.

Figure 1:
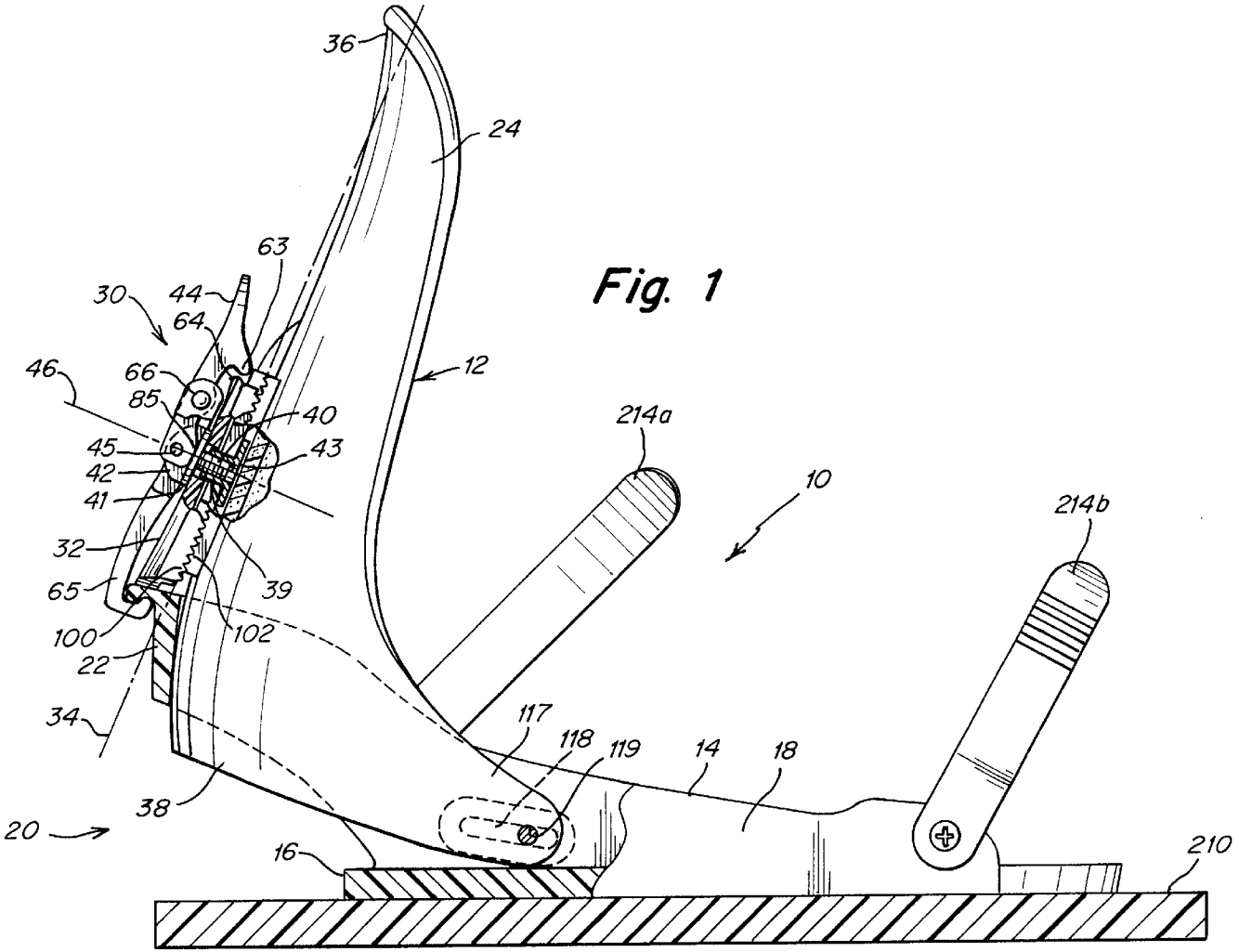
FIG. 1 is a side view of a snowboard binding implementing a tool-free system for a binding according to one aspect of the invention.

In one embodiment shown in FIG. 1, the binding 10 includes a leg support member 12 (also referred to as a highback) that is pivotally mounted to a base 14 for rotation in a heel-to-toe direction. The base 14 includes a baseplate 16 and sidewalls 18 (only one of which is shown) that extend rearwardly beyond the rear end 20 (i.e., heel) of the baseplate 16 and rise up to merge and form a curved heel hoop 22. The leg support member 12 is configured to transmit rider induced forces to the snowboard through the heel hoop 22 to provide heelside support and heel-edge control. The leg support member 12 includes an upright portion 24 that may be adapted to conform to the leg of a rider.

Figure 2:
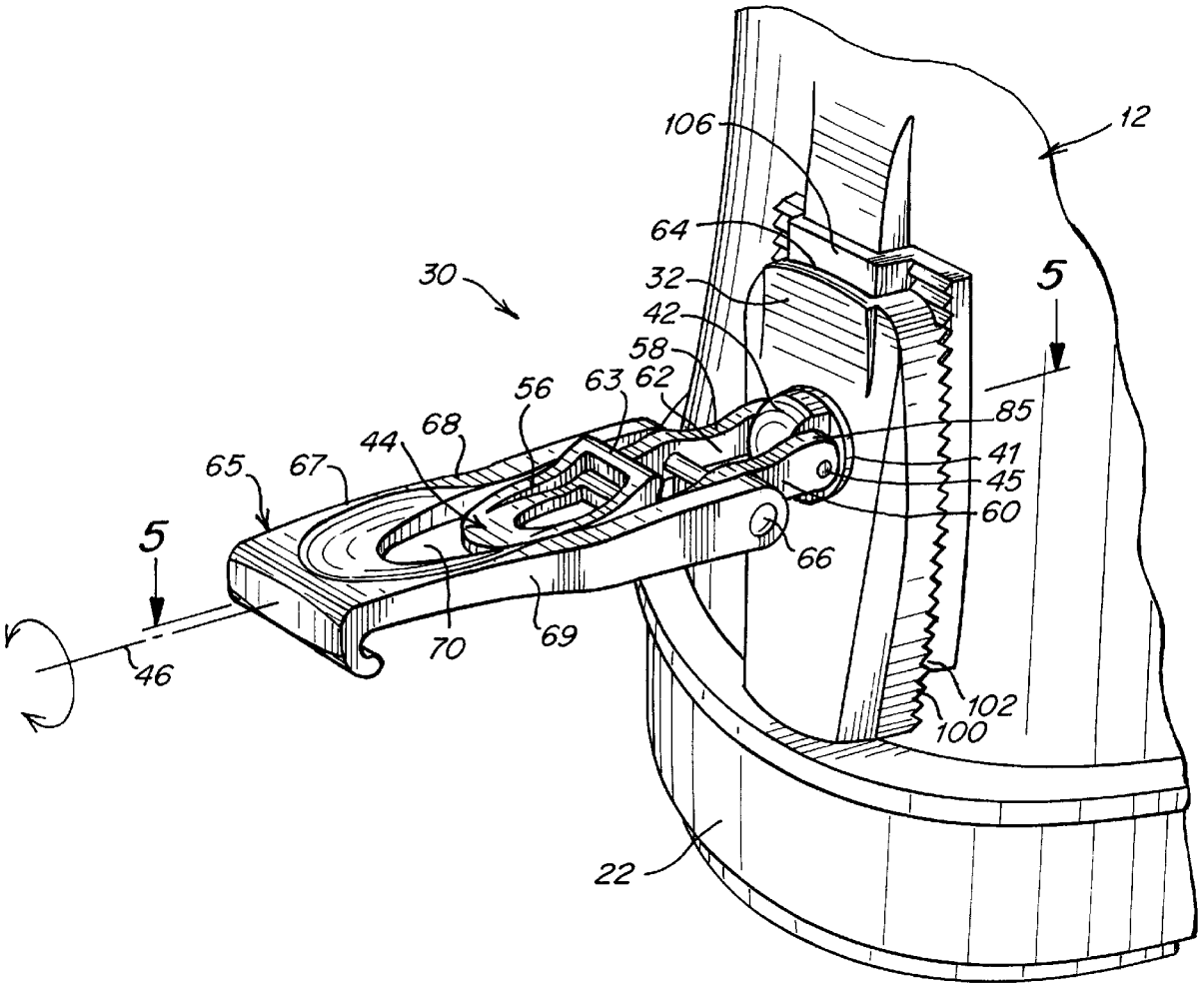
FIG. 2 is a perspective view of the tool-free system of FIG. 1.
Figure 3:
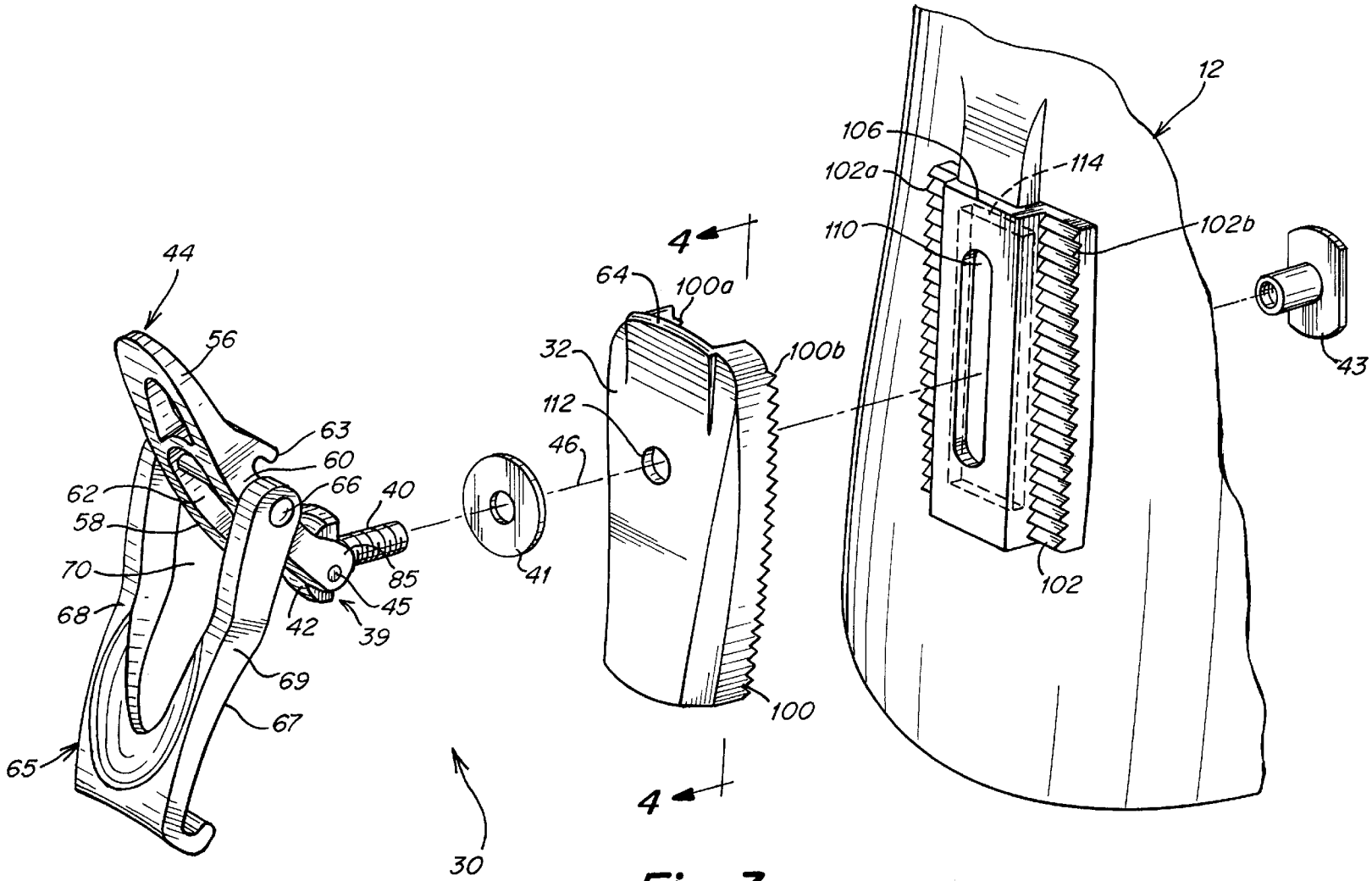
FIG. 3 is an exploded perspective view of the tool-free system of FIG. 2.

A tool-free forward-lean adjuster 30 is provided on the leg support member 12 to set its forward-lean angle (i.e., orientation) relative to the baseplate 16. According to one illustrative embodiment, as shown in FIGS. 1–3, the forward-lean adjuster 30 includes a body 32 that may be configured as a movable block or stop and that may be selectively positioned relative to the leg support member 12. The forward-lean of the leg support member 12 increases as the body 32 is moved in a downward direction from the top 36 of the leg support member 12 toward the bottom 38 of the leg support member 12.

The body 32 is secured to the leg support member 12 with a releasable fastener 39 that may be actuated without the use of a separate tool. In one embodiment, as best shown in FIG. 3, the releasable fastener includes a threaded stud 40, which has a head 42, that is engageable with a "T" nut 43 positioned along an inner portion of the leg support member 12. Of course, the stud 40 may be positioned along the inner portion of the leg support member and the "T" nut may be engageable with the threaded stud. A washer 41 may be positioned adjacent the body 32 to distribute forces acting on the body 32 as the stud 40 is secured to the "T" nut 43. The washer 41 may also provide a low friction surface to allow easy rotation of the head 42 of the stud 40. In one embodiment, the stud 40, the "T" nut 43 and the washer 41 are formed of metal, whereas the body 32 is formed of plastic.

Although this embodiment includes a fastener configured as a separate threaded stud and "T" nut, it is to be appreciated that the present invention is not limited in this respect and may employ other suitably configured fasteners. For example, the fastener may be molded or otherwise formed into the leg support member. Alternatively, the fastener may be configured as a cam-lock fastener or any other suitable twist-lock fastener. Other suitable fasteners may include ball detent locks and spring-loaded pins.

An actuator 44 is coupled to the fastener 39 so that the fastener may be tightened or loosened with the actuator and thereby eliminate the need for a separate tool. To facilitate actuation of the fastener 39, the actuator 44 may be configured to move into a suitable position for ease of manipulation. In this respect, as best shown in FIGS. 2 and 3, the actuator 44 may be pivotally attached to the head 42 of the fastener 39 via a pivot pin 45. As a result, the actuator 44 may be pivoted into any suitable orientation relative to the fastener ranging from substantially normal to the longitudinal axis 46 of the fastener 39 (as shown in FIG. 1) to substantially parallel to the longitudinal axis 46 of the fastener 39 (as shown in FIG. 2) or to any position in between (as shown in FIG. 3). The actuator 44 includes a bifurcated body 56, which may have two arms 58, 60 defining a slot 62 to receive the head 42 of the fastener 39. The pivot pin 45 may pass through one arm 58, into the head 42 of the fastener 39, and through the other arm 60.

In one illustrative embodiment as shown in FIGS. 2 and 3, the actuator 44 may be configured to reduce inadvertent movement from a locked position, which may otherwise cause inadvertent loosening of the fastener. In this respect, the actuator 44 may include a lip 63 which is adapted to cooperate with the top 64 of the body 32 so that the actuator 44 snaps into engagement with the body 32 to hold the actuator 44 in a locked position. The actuator 44 may be readily unsnapped from body 32 to facilitate actuation of the fastener 39.

The forward-lean adjuster 30 may also include a latch 65 to releasably secure the leg support member 12 to the base 14 to limit forward rotation (i.e., toe-edge travel) of the leg support member 12 relative to the base 14. In one embodiment, latch 65 includes a hook that is configured to releasably grasp the rim of the heel hoop 22 in any suitable location depending upon the lateral rotational orientation of the leg support member. One example of a suitable latch is described in the above-mentioned co-pending U.S. patent application Ser. No. 08/780,722, which is herein incorporated by reference in its entirety.

The latch 65 may also be coupled to the actuator 44, thereby providing a single actuator to operate both the latch 65 and the fastener 39. According to one aspect of the invention, while the fastener 39 and the latch 65 are each coupled to the actuator 44, actuation of the latch 65 occurs without simultaneous actuation of the fastener 39. In one embodiment, the latch 65 is pivotally attached to the actuator 44 via pivot pin 66. In this respect, pivoting of the actuator 44 about pivot pin 45 therefore causes pivoting of the latch 65 about pivot pin 66 so that the latch may engage or disengage the heel hoop, whereas rotation of actuator 44 about the fastener axis 46 causes loosening or tightening of the fastener 39. Thus, merely latching and unlatching the latch 65 with the actuator 44 does not disturb the position of the body 32 and the pre-selected forward-lean angle may be maintained. This feature may be useful, for example, when a rider wishes to move the leg support member into a storage position, without disturbing the pre-selected forward-lean angle.

It should be appreciated, however, that the invention is not limited in this respect and that the latch 65 and fastener 39 may each have a separate actuator. In this manner, actuation of the latch 65 also occurs independently of actuation of the fastener 39, thereby maintaining the desired forward-lean angle upon unlatching the latch.

The latch 65 also may be configured to nest with the actuator 44, as shown in FIG. 2, to facilitate grasping and manipulating the actuator and latch to selectively tighten or loosen the fastener, especially when the rider's hands are covered with gloves or mittens. In this respect, the latch 65 includes a bifurcated body 67, which may have two arms 68, 69 defining a slot 70 to receive the actuator 44. The pivot pin 66 may pass through one arm 68 into the actuator 44 and through the other arm 69. The slot 70 defined by the two arms 68, 69 of the latch 65 is sufficiently sized to receive the actuator 44, thereby allowing the actuator 44 and the latch 65 to attain a nested configuration upon pivoting of the actuator 44 and the latch 65 about the pivot pins 45, 66, respectively, toward each other.

In some instances, the fastener 39 may be fully tightened, yet the latch 65 may not be precisely aligned with the heel hoop for proper engagement therewith. Thus, it may be desirable to slightly loosen the fastener 39 so that the latch may obtain proper alignment. Because the body 32 now may not be fully secured to the leg support member, in one illustrative embodiment, the actuator may be configured to bear against the body 32 upon pivoting about pivot pin 45. In this respect, the actuator 44 may include a cam lobe 85. As the actuator is pivoted about pivot pin 45, the cam lobe forces the body 32 against the leg support member 12, thereby causing the body 32 to become fully secured.

To limit longitudinal movement of the body 32 relative to the leg support member 12 while maintaining adjustability, the body 32 may be formed with a rack of teeth 100, which cooperate with a corresponding rack of teeth 102 formed on the leg support member 12. The racks of teeth 100, 102 may be sized to provide relatively small increments of adjustment of the body 32 relative to the leg support member 12 for setting the desired forward-lean. However, it should be appreciated that the present invention is not limited in this respect and that other suitable engaging surfaces, such as smooth or rough surfaces or recesses and corresponding protrusions or pins may be used.

Figure 4:
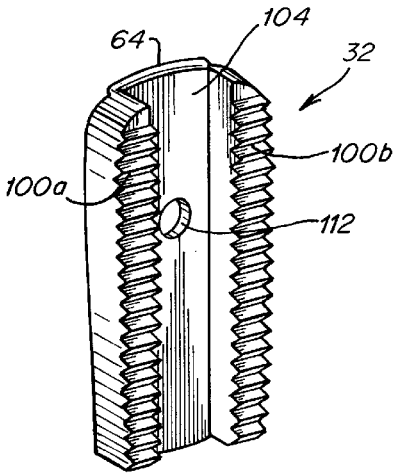
FIG. 4 is a rear perspective view of a portion of the of the tool-free system taken along view line 4—4 of FIG. 3.

In one illustrative embodiment, the body 32 engages the leg support member in a manner that limits lateral movement therebetween. In this respect, as shown in FIG. 4, a longitudinally extending recess 104 may be formed in the surface of the body 32 facing the leg support member 12. A corresponding longitudinally extending boss 106 (see FIGS. 2 and 3) may be formed on the leg support member to engage the recess 104. It is to be appreciated that the body 32 may be formed with a boss and the leg support member 12 may be formed with a corresponding recess. The recess 104 may divide the rack of teeth 100 into a pair of racks of teeth 100*a*, 100*b*. Similarly, the boss 106 formed on the leg support member 12 may divide the rack of teeth 102 into a pair of racks of teeth 102*a*, 102*b* (see FIG. 3) that cooperate with the pair of racks of teeth 100*a*, 100*b* on the body 32.

To allow body 32 and the fastener 39 to move along the longitudinal axis 34 of the leg support member for placement into a desired forward-lean position, the leg support member 12 may have a longitudinally extending slot 110 formed therein, as shown in FIG. 3. In particular, the slot 110 may be formed through the boss 106 and into the inside surface of the leg support member. The body 32 may also include a hole 112 so that the stud 40 may pass therethrough and into the slot 110 formed on the leg support member 12. The "T" nut 43 attaches to the stud 40 from the inside surface of the leg support member 12 and may slide in slot 110.

Figure 5:
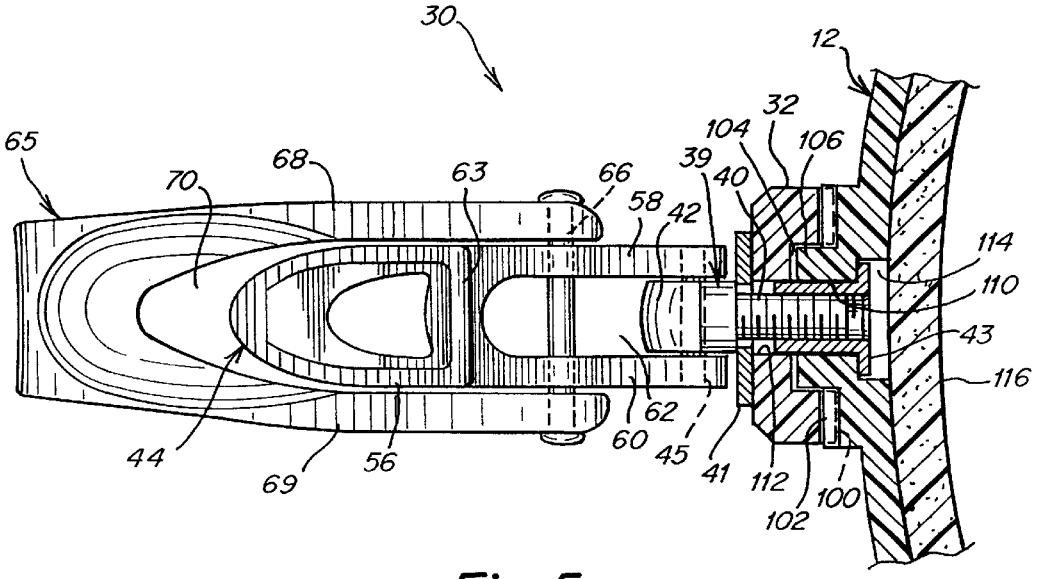
FIG. 5 is a partial cross-sectional view of the tool-free system taken along section line 5—5 of FIG. 2.

In one illustrative embodiment, the fastener 39 is located in a suitable position so as not to extend into the space typically occupied by the rider's boot. As shown in FIG. 5, a longitudinally extending depression 114 may be formed in the inside surface of the leg support member 12. The depression is configured to receive the "T" nut 43 so that it may sit flush with the inside surface of leg support member 12. A pad 116 may be placed on the inside surface of the leg support member, which may or may not cover the "T" nut 43.

As shown in FIG. 1, the leg support member 12 may include a pair of extension arms 117 formed on opposite sides thereof (only one of which is shown in FIG. 1) that project forward and terminate adjacent oblong mounting slots 118 formed in the lateral sides of the sidewalls 18. The extension arms include holes 119 adapted to align with the mounting slots 118. Suitable fasteners extend through the mounting slots 118 and holes 119 to secure the leg support member to the baseplate at desired connection points.

The mounting slots also allow rotation of the leg support member about an axis substantially normal to the baseplate. This rotation, commonly referred to as lateral rotation, may be selectively adjusted by the rider to compensate for the stance angle of the baseplate relative to the board. Specifically, one connection point may be shifted toward the heel end of the baseplate while the other connection point may be shifted toward the toe end of the baseplate, thereby creating a rotation of the leg support member about the substantially normal axis. Although the mounting slots 118 are shown and described as formed in the sidewalls 18, the mounting slots 118 may be formed in any suitable location on the base 14, such as the heel hoop 22, or on the leg support member 12, such as the extension arms 117. Also, although an oblong mounting slot is shown and described, a plurality of spaced or overlapping holes may be employed.

Figure 6:
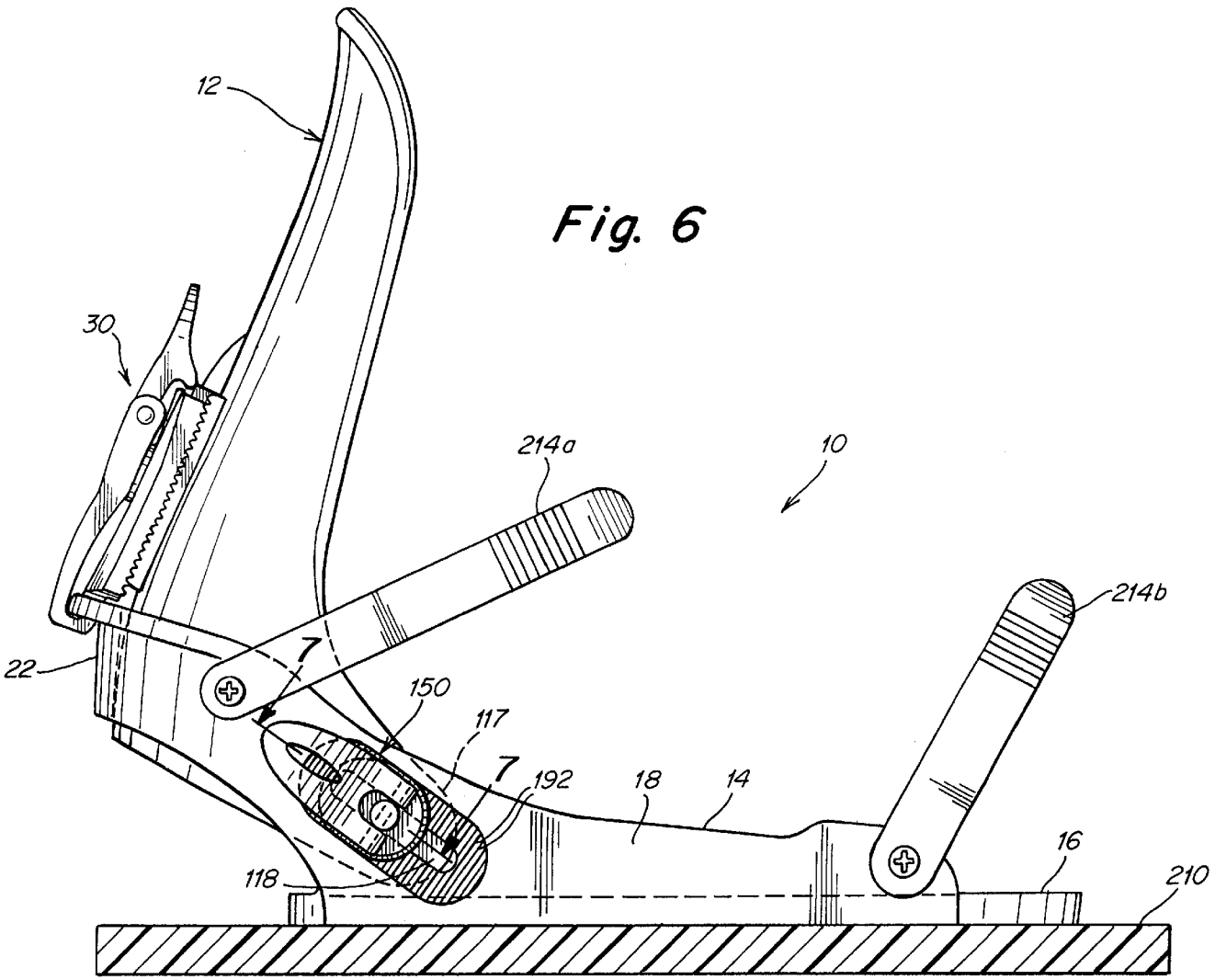
FIG. 6 is a side view of a snowboard binding implementing a tool-free system and a tool-free lock for securing a leg support member to the binding baseplate according to another aspect of the invention.
Figure 7:
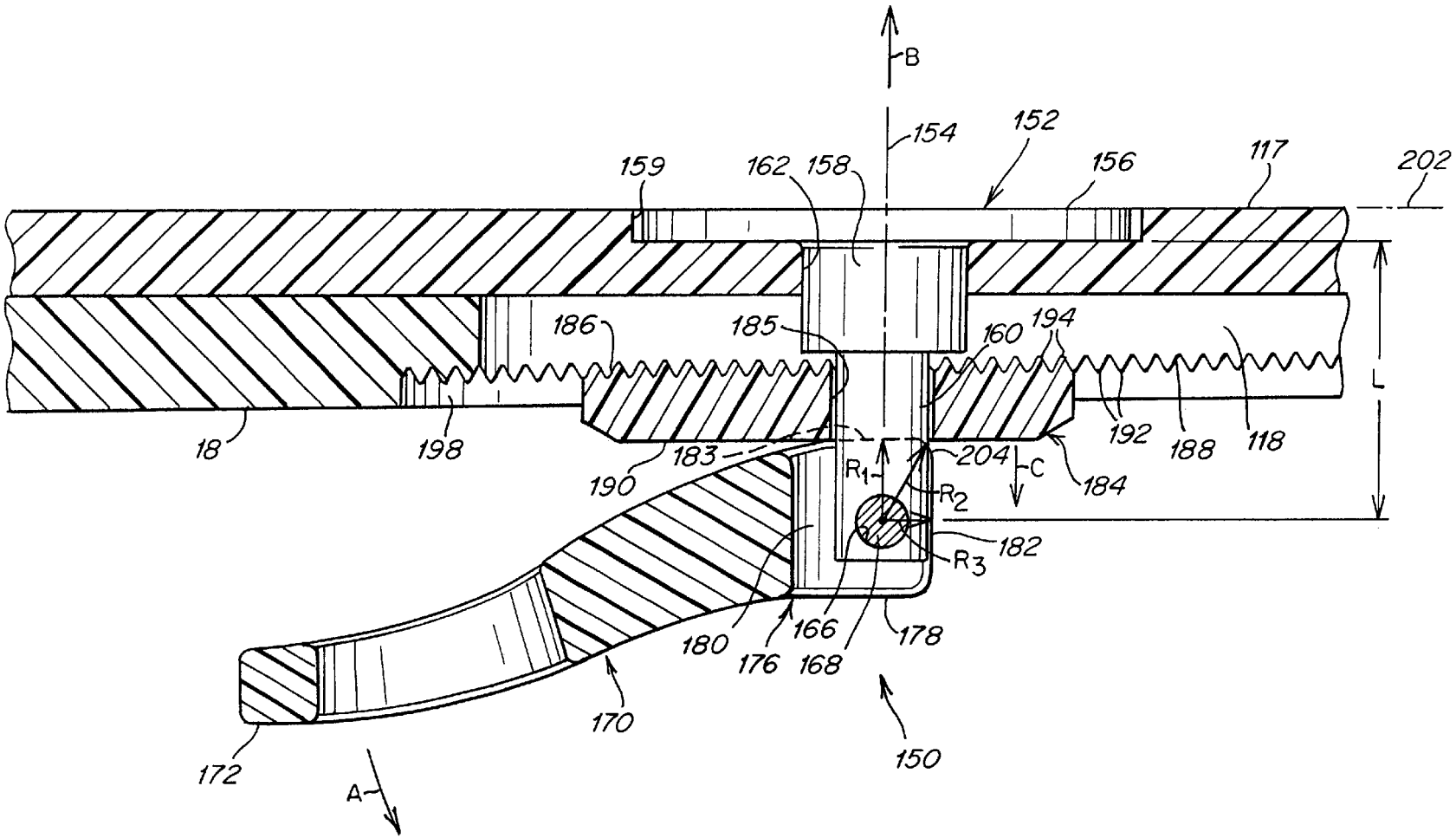
FIG. 7 is a cross-sectional view taken along section line 7—7 of FIG. 6 illustrating the tool-free lock in a locked position.
Figure 8:
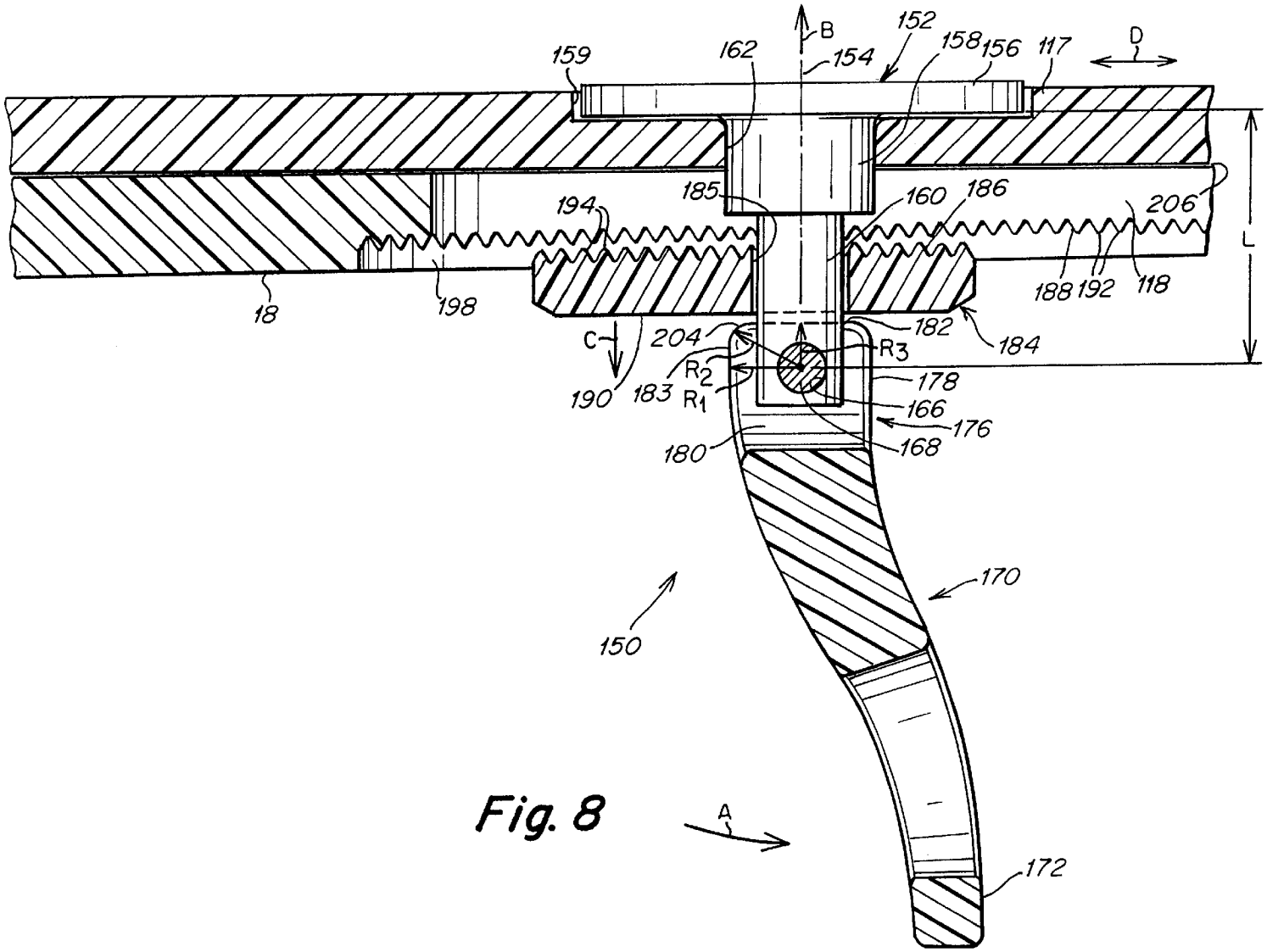
FIG. 8 is the cross-sectional view of the tool-free lock of FIG. 7 shown in an unlocked position.

Suitable fasteners to secure the leg support member 12 to the base 14 may include screw and nut assemblies, which require actuation with the use of a separate tool. According to another aspect of the invention as shown in FIGS. 6–8, the leg support member 12 may be secured to the base 14 with at least one, and preferably a pair of, tool-free locks 150 (only one of which is shown). Thus, changing the orientation of the leg support member may occur quickly and without the use of a separate tool. Preferably, the lock 150 is fixedly connected to either the base, the leg support member, or to both components, so that the lock is not separated from the binding during reorientation of the leg support member.

One illustrative embodiment of such a tool-free lock is shown in FIG. 7. The tool-free lock 150 is configured as a cam-actuated lock and includes a plunger 152 having a cap 156, a body 158 extending from the cap 156, and a stud 160 extending from the body 158. The body 158 passes through an opening 162 formed in the extension arm 117 and through the slot 118. The cap 156 engages the extension arm 117, preferably in mating relation with a compatible recess 159 in the extension arm 117, to prevent axial movement of the plunger 152 relative to the extension arm 117 along an axis 154 in a direction toward the outer perimeter of the binding 10. A lever arm 170, having an extension portion 172 and a yoke portion 176, may be pivotally mounted to the stud 160 about a pin 168 extending through a transverse hole 166. The yoke portion 176 may include two cam lobes 178 (only one of which is shown) and an opening 180 therebetween. The stud portion 160 extends into the opening 180, thereby allowing the lever arm 170 to pivot about pin 168. Because the lever arm 170 may be attached to the plunger 152 and the plunger 152 may be axially secured relative to the extension arm 117, a self-contained cam-actuated lock may be provided.

As illustrated, each cam lobe 178 includes a dwell surface 182 and a bearing surface 183 for pressing against the sidewall 18 when actuated to the locked position of FIG. 7. The cam lobes are configured to draw the plunger 152 toward the sidewall 18 and the lever arm 170 in a manner which creates a significant amount of tension on the plunger 152, thereby causing a substantial compressive force between the extension arm 117 and the sidewall 18. The cam lobes may be configured with a bearing radius "$R_1$", which is defined by the radius between the bearing surface 183 and the center of pin 168, and a distance "L", which is defined by the distance between the intersection of the cap 156 and the body 158 of the plunger 152 and the center of pin 168, to provide a predetermined amount of tension on the plunger. In one embodiment, the bearing radius "$R_1$" may be about 3.2 mm and the distance "L" may be about 11.55 mm. It is to be appreciated that other suitable configurations may be implemented to achieve a desired tension.

The lock 150 may also include an oblong-shaped locking plate 184 having an opening 185 formed therethrough to receive the stud 160. The locking plate 184 includes an inner surface 186 constructed and arranged to mate with a corresponding surface 188 of sidewall 18. The locking plate 184 similarly includes a bearing surface 190, which is adapted to mate with the bearing surface 183 of lever arm 170. The bearing surface 183 displaces the locking plate 184 toward the sidewall 18 when in the locked configuration.

To more positively lock the leg support member 12 in its desired position, the surface 188 of the sidewall 18 adjacent the oblong mounting slot 118 may be provided with teeth 192. The locking plate 184 may similarly include complementary mating teeth 194.

In an illustrative embodiment, the teeth 192 of the sidewall 18 may be formed in a recess 198 to reduce the overall profile of the cam-actuated lock 150. In addition, providing the recess 159 in the extension arm 117 limits the extent to which the cap 156 of the plunger 152 protrudes into the area occupied by the boot of a rider. Thus, the cap 156 may lie substantially in the plane 202 of the extension arm 117.

In the illustrative embodiment, the tool-free lock 150 is formed in an over-center arrangement that includes a fulcrum 204 disposed between the dwell surface 182 and a bearing surface 183. To move between a locked position and an unlocked position, the fulcrum 204 passes through the axis 154 of the plunger 152. In addition, at the point where the fulcrum 204 lies on the axis 154, the lever arm 170 lies in an unstable position where it will tend to move into either the locked or unlocked position. Thus, once placed in the locked position, the lever arm 170 will tend to remain in the locked position because any axial force which tends to pull the plunger 152 away from the lever arm 170 in a direction labeled "B" when the lever arm 170 is in the locked position will have the effect of maintaining the lever arm 170 in the locked configuration. In this embodiment, the fulcrum radius "$R_2$", (defined as the radius between the center of pin 168 and the fulcrum 204) is greater than the bearing radius "$R_1$". In one embodiment, the fulcrum radius "$R_2$" may be about 3.162 mm. However, it is to be appreciated that other suitable dimensions may be implemented.

In the unlocked configuration of FIG. 8, the lever arm 170 has been rotated in the direction shown as arrow "A", wherein the tension on the plunger 152 has been relieved and is now free to move in a direction shown as arrow "B". The substantial compressive force between the extension arm 117 and the sidewall 18 is thus released, thereby allowing the locking plate 184 to move in the direction shown as arrow "C". A small gap 206 may thus be formed between the extension arm 117 and the sidewall 18, thereby allowing extension arm 117 to move toward the heel end or toe end of the base, as desired, in a direction shown as arrow "D".

In one embodiment, the dwell radius "$R_3$", which is defined by the radius between the center of pin 168 and the dwell surface 182, is less than both the bearing radius "$R_1$" and the fulcrum radius "$R_2$" and is about 2.5 mm. It is to be appreciated that other suitable dimensions may be implemented. Because the fulcrum radius "$R_2$" is greater than the dwell radius "$R_3$", when the lever arm 170 is in the unlocked position, the lever arm 170 will tend to remain in the unlocked configuration. This allows adjustment of the leg support member 12 without the lever arm 170 inadvertently moving into the locked configuration.

This over-center arrangement also allows for a tactile response when the cam-actuated lock 150 moves between the locked position and the unlocked position. As the lever arm 170 is rotated into the locked position, the resistance felt by the operator tends to increase until the fulcrum 204 is bearing against the sidewall 18 (or the locking plate 184, if provided). Once the fulcrum 204 passes the over-center position (i.e., passes through the axis 154), a further locking movement causes the operator to feel a decrease in resistance. Thus, the operator may be assured that the cam-actuated lock 150 is properly locked. However, it should be appreciated that the present invention is not limited in this respect and that an over-center arrangement need not be employed.

Although the tool-free lock 150 is described with reference to a cam-actuated lock, it is to be appreciated that other suitable tool-free locks may be used. In this respect, the tool-free lock 150 may be configured as a twist-type fastener having an actuator mounted thereto as described above with reference to the tool-free forward-lean adjuster. Also, other suitable fasteners may be used such as a ball detent fastener or a spring-load pin fastener.

The binding 10 described herein includes sidewalls and a baseplate formed from a single integrally molded piece. However, the sidewalls and/or baseplate may be made of two or more components joined together. The baseplate of the binding may be mounted to a snowboard 210 (see FIGS. 1 and 6) in any suitable manner. One example of such a mounting includes the use of a hold-down disc cooperating with a corresponding aperture in the bottom wall. The hold down disc may include holes for receiving a plurality of screws that may be engaged to fastener inserts in the snowboard 210.

One or more binding straps, preferably adjustable straps, may extend across portions of the binding 10 for securing a boot to the snowboard 210. The binding 10 may include an ankle strap 214*a* that extends across the ankle portion of the boot to hold down the rider's heel and a toe strap 214*b* that extends across the binding 10 and holds down the front portion of the boot. Each strap may be attached to sidewalls 18 by a bushing and/or fastener. It is to be understood that the binding 10 may include a single binding strap, such as a unitary strap, an ankle strap, or may include additional straps, such as a shin strap (not shown). In addition, it should be appreciated that the straps may be attached to other regions of the base 14. Alternatively, the binding may be configured as a step-in binding that typically does not employ straps, but rather includes one or more strapless engagement members (not shown) into which the rider can step into and lock the boot into the binding. A variety of both strap bindings and step-in bindings are now commercially available.

In addition, although the forward-lean adjuster described herein is mounted to the leg support member, it should be appreciated that the present invention is not limited in this respect and that the forward-lean adjuster may be mounted to any suitable location on the binding. For example, the forward-lean adjuster may be mounted to the heel hoop.

Specially configured boards for gliding along a terrain are known, such as snowboards, snow skis, water skis, wake boards, surf boards and the like. For purposes of this patent, "gliding board" will refer generally to any of the foregoing boards as well as to other board-type devices which allow a rider to traverse a surface. For ease of understanding, however, and without limiting the scope of the invention, the inventive tool-free selectively adjustable highback to which this patent is addressed has been discussed particularly in connection with a snowboard. However, it should be appreciated that the present invention is not limited in this respect, and that aspects of the present invention can be used in association with other types of gliding boards and other boards where a person's feet are secured to a board.

While the invention has been described in detail, those skilled in the art to which this invention relates will recognize various alternative embodiments including those mentioned above as defined by the following claims.

What is claimed is:

1. A tool-free system for retaining a leg support member of a binding in a selected orientation, the binding having a base and a leg support member constructed and arranged for selective orientation relative to the base, the system comprising:

a tool-free forward-lean adjuster comprising:

a body that is selectively mountable to the leg support member in a plurality of positions to set the leg support member at a selected forward-lean angle;

a fastener configured and arranged to secure the body to the leg support member in one of the plurality of positions to prevent movement of the body relative to the leg support member; and a tool-free actuator coupled to the fastener to allow tool-free actuation of the fastener to selectively tighten and loosen the body against the leg support member; and a latch operatively coupled to the tool-free forward-lean adjuster, the latch having a locking portion constructed and arranged for releasably engaging the base to prevent toe-edge pivoting of the leg support member, the latch configured and arranged to move between a first position in which the locking portion is engageable with the base and a second position in which the locking portion is disengageable from the base, the latch being movable between the first and second positions without simultaneous actuation of the fastener.

2. The system according to claim 1, wherein the latch is operatively coupled to the actuator, the latch constructed and arranged to attain a configuration suitable to allow tool-free actuation of the fastener.

3. The system according to claim 2, wherein the fastener is a twist-lock fastener and wherein the latch is constructed and arranged to rotate the twist-lock fastener to selectively tighten and loosen the fastener.

4. The system according to claim 1, wherein the latch is operatively coupled to the actuator, the actuator being configured and arranged to move the latch between the first and second positions.

5. The system according to claim 4, wherein the actuator and the latch are constructed and arranged to attain a configuration suitable to allow tool-free actuation of the fastener.

6. The system according to claim 4, wherein the latch comprises a bifurcated body having two arms extending therefrom, the actuator being disposed between the arms.

7. The system according to claim 1, wherein the fastener includes a twist-lock fastener.

8. The system according to claim 7, wherein the twist-lock fastener includes a threaded fastener.

9. The system according to claim 8, wherein the threaded fastener includes a threaded stud coupled to the actuator.

10. The system according to claim 1, wherein the actuator comprises a bifurcated body having two arms extending therefrom, the fastener being disposed between the arms.

11. The system according to claim 1, wherein the actuator is pivotally attached to the fastener.

12. The system according to claim 1, wherein the actuator includes a lip disposed thereon, the lip being adapted to engage the body of the forward lean adjuster to hold the actuator in a locked position.

13. The system according to claim 1, wherein the body includes a rack of teeth configured to engage the leg support member.

14. The system according to claim 13, wherein the body includes one of a longitudinally extending recess and a boss that divides the rack of teeth into a pair of racks of teeth.

15. The system according to claim 1, in combination with the leg support member, wherein the fastener selectively secures the body to the leg support member.

16. The combination according to claim 15, wherein the body includes one of a longitudinally extending recess and a boss and the leg support member including the other one of the longitudinally extending boss and the recess, the recess and the boss cooperating to limit relative lateral movement between the body and the leg support member.

17. The combination according to claim 15, wherein the body includes means for matingly engaging the leg support member when the body is secured thereto.

18. The combination according to claim 15, wherein the body comprises a first rack of teeth and the leg support member comprises a second rack of teeth configured to mate with the first rack of teeth.

19. The combination according to claim 15, wherein the leg support member comprises a longitudinally extending slot adapted to receive the fastener.

20. The combination according to claim 15, wherein the leg support member includes a longitudinally extending depression adapted to slidingly receive the fastener.

21. The combination according to claim 15, in combination with the binding, the binding including the base and the leg support member mounted to the base for selective orientation relative to the base.

22. The combination according to claim 21, further comprising at least one tool-free lock constructed and arranged to secure the leg support member to the base at at least one mounting location.

23. The combination according to claim 22, wherein the at least one mounting location includes a first and a second mounting location and wherein the at least one tool-free lock includes a first and a second tool-free lock, the first tool-free lock locking the leg support member to the base at the first mounting location and the second tool-free lock locking the leg support member to the base at the second mounting location.

24. The combination according to claim 22, wherein the leg support member includes a side portion, the at least one tool-free lock locking the side portion of the leg support member to the base.

25. The combination according to claim 24, wherein the side portion includes an extension arm, the at least one tool-free lock locking the extension arm to the base.

26. The combination according to claim 25, wherein the base includes a lateral side, the at least one tool-free lock locking the extension arm to the lateral side of the base.

27. The combination according to claim 22, wherein the at least one tool-free lock includes a cam having a locked position, wherein the cam causes a substantial compressive force between the leg support member and the base, and an unlocked position, wherein the cam releases the substantial compressive force between the leg support member and the base.

28. The combination according to claim 27, wherein the at least one tool-free lock includes a bearing plate having a bearing surface cooperating with the cam, the bearing plate being disposed between the cam and one of the base and the leg support member for distributing the compressive force.

29. The combination according to claim 28, wherein the bearing plate is oblong in shape.

30. The combination according to claim 28, wherein the bearing plate includes teeth formed on a surface thereof opposite the bearing surface.

31. The combination according to claim 28, wherein one of the leg support member and the base includes teeth formed on a surface thereof for matingly engaging the teeth formed on the surface of the bearing plate.

32. The combination according to claim 22, wherein the at least one tool-free lock is configured as an over-center lock having a locked position, wherein the leg support member is locked to the base; an unlocked position, wherein the leg support member is free to move relative to the base; and, an intermediate position, wherein the at least one tool-free lock tends to move to one of the locked position and the unlocked position.

33. The combination according to claim 32, wherein the tool-free lock includes an actuator that provides tactile feedback as the tool-free lock transitions through the intermediate position.

34. The combination according to claim 22, wherein the leg support member includes an opening formed therein and a recess formed around the opening and wherein the base includes a slot formed therein that is aligned with the opening, the at least one tool-free lock comprising:

a plunger having a cap and a stud extending from the cap, the stud passing through the opening formed in the leg support member and through the slot formed in the base, the cap matingly engaging the recess to prevent axial movement of the plunger toward the base; and, a cam cooperating with the plunger to move the plunger between a locked position, wherein the plunger causes a substantial compressive force between the leg support member and the base, and an unlocked position, wherein the plunger releases the substantial compressive force between the leg support member and the base.

35. The combination according to claim 22, wherein the at least one tool-free lock comprises a first tool-free lock positioned on a first side of the binding and a second tool-free lock positioned on a second side of the binding, and wherein the tool-free forward lean adjuster is positioned at a rear of the binding between the first and second sides.

36. The combination according to claim 21, wherein the base includes a baseplate and a heel hoop extending from the baseplate.

37. The combination according to claim 36, wherein the leg support member is mounted to the baseplate and abuts the heel hoop.

38. The binding according to claim 21, wherein the forward-lean adjuster is adjustably mounted to the leg support member.

* * * * *